US006783020B2

(12) United States Patent
Featherston et al.

(10) Patent No.: US 6,783,020 B2
(45) Date of Patent: Aug. 31, 2004

(54) TODDLER DRINKING CUP

(75) Inventors: David E. Featherston, Rockford, MI (US); Brenda J. Meyers, Reedsburg, WI (US); Charles Quinn, Sun Prairie, WI (US)

(73) Assignee: Gerber Products Company, Fremont, MI (US)

( * ) Notice: Subject to any disclaimer, the term of this patent is extended or adjusted under 35 U.S.C. 154(b) by 6 days.

(21) Appl. No.: 10/295,330

(22) Filed: Nov. 15, 2002

(65) Prior Publication Data

US 2004/0094552 A1 May 20, 2004

(51) Int. Cl.[7] ..... B65D 51/18

(52) U.S. Cl. ..... 220/254.8; 220/703; 215/387

(58) Field of Search ..... 220/254.8, 254.9, 220/259.3, 259.4, 715, 714, 719, 724–727, 703; 215/387

(56) References Cited

U.S. PATENT DOCUMENTS

| | | | | | |
|---|---|---|---|---|---|
| 93,171 | A | | 8/1869 | Burghartt | |
| 1,674,332 | A | | 6/1928 | Jeanmaire | |
| 3,338,467 | A | * | 8/1967 | Albert | 220/714 |
| 4,054,205 | A | | 10/1977 | Blow, Jr. et al. | |
| 4,184,603 | A | * | 1/1980 | Hamilton, Sr. | 220/254.9 |
| 4,190,173 | A | | 2/1980 | Mason et al. | |
| 4,362,254 | A | | 12/1982 | Roth et al. | |
| 4,582,668 | A | | 4/1986 | Mallory et al. | |
| 4,871,077 | A | | 10/1989 | Ogden et al. | |
| 4,911,323 | A | | 3/1990 | Arfert et al. | |
| D328,014 | S | | 7/1992 | DeCoster et al. | |
| 5,249,703 | A | * | 10/1993 | Karp | 220/719 |
| 5,294,014 | A | * | 3/1994 | Wyatt et al. | 220/253 |
| D350,460 | S | | 9/1994 | Picozza et al. | |
| D354,602 | S | | 1/1995 | Goubaud | |
| 5,456,380 | A | | 10/1995 | Ito et al. | |
| 5,490,622 | A | | 2/1996 | Tardif | |
| D368,629 | S | | 4/1996 | Verbovszky | |
| 5,634,566 | A | | 6/1997 | Jansen et al. | |
| D383,037 | S | | 9/1997 | Asberg | |
| 5,680,951 | A | | 10/1997 | Feltman, III et al. | |
| D388,660 | S | | 1/1998 | Gründl | |
| 5,704,510 | A | | 1/1998 | Feltman, III et al. | |
| D391,848 | S | | 3/1998 | Everard et al. | |
| D392,845 | S | | 3/1998 | Lown et al. | |
| 5,899,349 | A | | 5/1999 | Moore | |
| 5,918,761 | A | | 7/1999 | Wissinger | |
| 5,947,315 | A | | 9/1999 | Valyi et al. | |
| 5,961,004 | A | | 10/1999 | DeMars | |
| 5,964,379 | A | | 10/1999 | DeMars | |
| 6,010,029 | A | * | 1/2000 | Wang | 220/714 |
| D421,877 | S | | 3/2000 | La Torre et al. | |
| D421,878 | S | | 3/2000 | Roehrig | |
| D422,179 | S | | 4/2000 | Stephenson | |
| 6,102,244 | A | | 8/2000 | Kuwano et al. | |
| D436,296 | S | | 1/2001 | Freed | |
| 6,170,693 | B1 | | 1/2001 | Goto | |
| D437,230 | S | | 2/2001 | Andrew | |
| 6,186,367 | B1 | | 2/2001 | Harrold | |
| 6,188,053 | B1 | | 2/2001 | Wyatt | |
| 6,202,877 | B1 | | 3/2001 | La Torre et al. | |
| D442,029 | S | | 5/2001 | Otake | |
| D442,030 | S | | 5/2001 | Freed | |
| 6,234,338 | B1 | | 5/2001 | Searle | |
| D456,265 | S | | 4/2002 | Spear | |
| D457,035 | S | | 5/2002 | Hurlbut | |
| 6,659,302 | B2 | * | 12/2003 | Lin | 220/254.8 |
| 2003/0089713 | A1 | * | 5/2003 | Belt et al. | |

* cited by examiner

*Primary Examiner*—Lien Ngo
(74) *Attorney, Agent, or Firm*—John W. Kung

(57) ABSTRACT

A cup that is used for children that transitions them from sippy cups to conventional drinking cups. The cup does not require any suction by the child when drinking yet is spill proof when locked for transit. The cup features a reservoir, a top and a lid. Within the top is a central passage and a plate that contains vents. When closed, the lid is flush against the plate and prevents any liquid from leaking. When the lid is rotated open, a gap is exposed between the lid and plate to allow liquid to flow from the reservoir and through the vents to the child's mouth. Regardless of whether the lid is opened or closed, the lid always remains below the top rim of the top.

7 Claims, 6 Drawing Sheets

TODDLER DRINKING CUP

FIELD OF THE INVENTION

The present invention involves the field of beverage containers. Specifically, the invention is directed to a beverage container for a child, or toddler, the beverage container being suited to transition the child from a sippy cup to a conventional drinking cup.

BACKGROUND OF THE INVENTION

Drinking vessels for infants and children are known. For example, it is desirable to provide cups to meet the special demands created by infants and toddlers. Currently available to meet these needs are spill proof cups, or sippy cups. Sippy cups features valves attached to a lid. Extending outwardly from the lid is a spout. As the child provides suction on the spout, the valve in the lid opens allowing fluid to pass from the reservoir of the cup through the spout and into the child's mouth. Sippy cups are ideal for transitioning an infant from a baby nurser to a cup-like vessel since both container only allow fluid to flow when suction is initiated by the child.

However, transitioning a child from a sippy cup to a conventional drinking cup can be an onerous task. The main difference between a conventional drinking cup and a sippy cup is that a conventional drinking cup requires minimal suction by the child. Furthermore, conventional cups have an open top thus making the cup susceptible to spilling large quantities of beverage whenever the cup is tipped. Furthermore, because there is no spout on a conventional cup, the child must maneuver the rim of the cup to her mouth and lift the cup to allow the fluid to flow into her mouth, thus, increasing the probability and occurrence of a spilling. Thus, it is desirable to provide cups with means to simulate the rim of a conventional cup while providing means achieve portability of the cup with minimal spillage.

SUMMARY OF THE INVENTION

It is thus an object of the present invention to provide cup that helps a child or toddler transition from a sippy cup to a conventional cup.

It is yet another object of the present invention to provide a cup that causes the child or toddler to drink from the rim of a cup rather than a nipple or spout.

It is a further object of the present invention to provide a cup that minimizes the occurrence of leaks and spills while the child is learning how to drink from a cup.

It is still a further object of the present invention to provide a cup that is lightweight, easily used and easily cleaned.

This and other objects and advantages of the present invention are achieved by a container adapted for use by a child, or toddler, that has, e.g., three separable components: a reservoir, a top and a lid. The reservoir serves to hold any potable liquid. The top threads onto the open end of the reservoir. The top optionally includes a plate that extends across the open end of the reservoir. The plate also includes a central passage therein and a groove along its upper perimeter. A rim projects and extends upwardly from the plate of the top. The lid includes an upper disc portion and a lower cylindrical portion projecting and extending from the bottom surface of the lid. The bottom of the upper disc portion has a perimeter edge that extends axially for engaging the groove of the plate. The lower cylindrical portion further includes flexible position tabs that snap onto an internal threaded wall that defines the central opening in the top. Upon attachment, the lid is positioned below the top edge of the upper rim of the top. The perimeter of the lid that touches the top forms a seal that prevents liquid from flowing out. The lid, e.g., is rotatable with respect to the top. The ramp of the internal threads causes, when the lid is rotated, a separation between the disc portion of the lid and the plate of the top. Vents in the plate of the top permit passage of beverage when the disc portion of the lid is separated from the surface of the plate. Regardless of whether lid is in an open or closed position, the lid always remains below the top edge of the rim of the top.

Numerous, other objects, features and advantages of the present invention will readily become apparent from the following detailed description, from the claims and from the accompanying drawings.

BRIEF DESCRIPTION OF THE DRAWINGS

The accompanying drawings, which are incorporated in and constitute a part of the specification, illustrate an exemplary embodiment of the present invention.

DETAILED DESCRIPTION OF THE INVENTION

Figure 1:
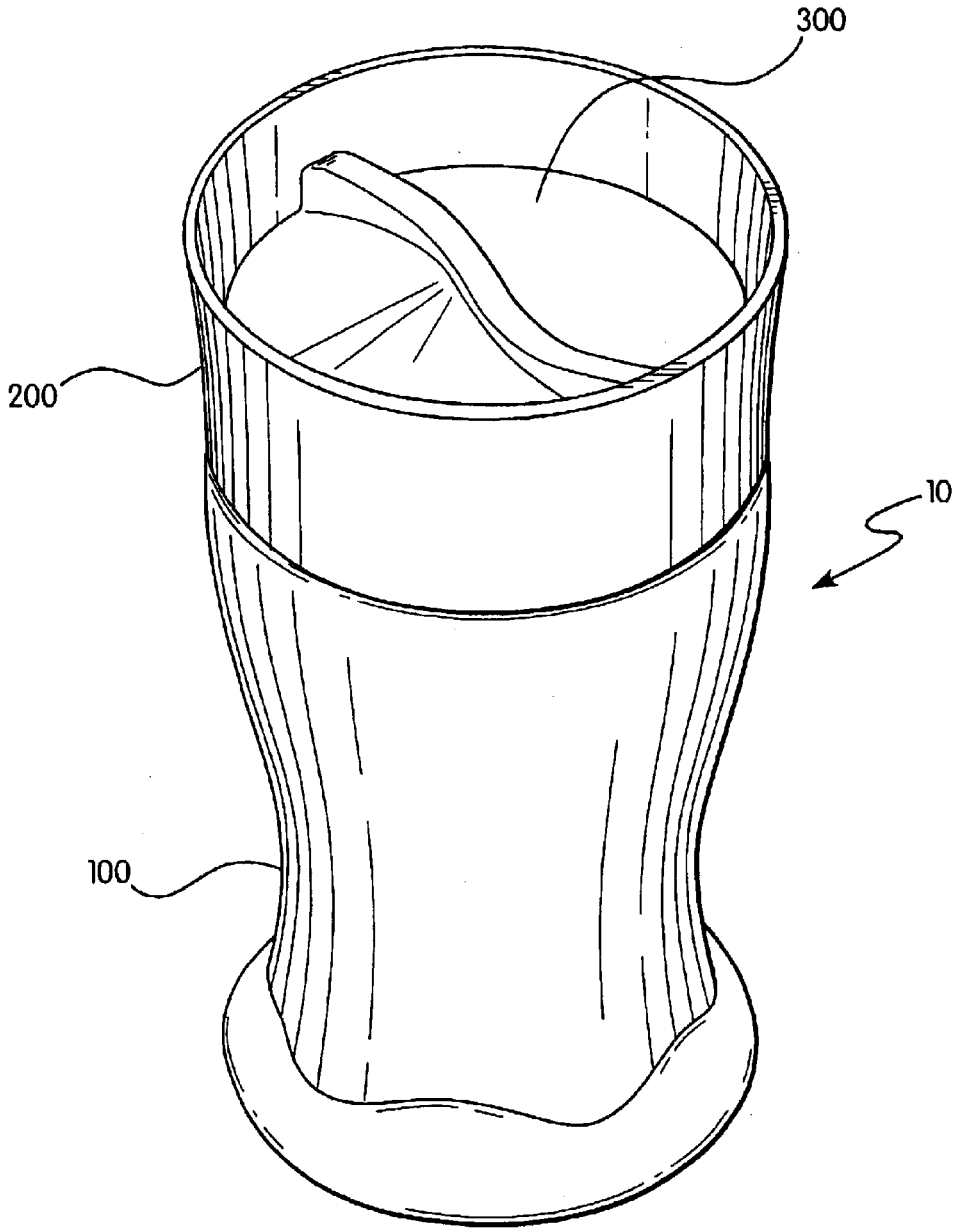
FIG. 1 is a perspective view of a cup in accordance with an embodiment of the present invention.

Referring to the drawings and, in particular, FIG. 1, there is shown an exemplary embodiment of a container of the present invention generally represented by reference number 10. The container 10 is preferably substantially cylindrical in shape, but may be of any shape that is adaptable for use as a container by children. For the purposes of describing an exemplary embodiment of the container 10, the container 10 is illustrated to be cylindrical. Thus, the three main components of container 10, reservoir 100, top 200 and lid 300 are substantially cylindrical and/or circular. The number of main components of the container 10 may be varied to be more or less. For example, the reservoir 100 and the top 200 may be formed as a single unitary component. All of the components of the container 10 may be of the same or different materials. For example, a preferred material is a thermoplastic polymer which, e.g., can be a homo-polymer or co-polymer. Examples of thermaplastic polymers include, but are not limited to, polyethylene, polypropylene, polystyrene, high-density polyethylene, low-density polyethylene, linear low-density polyethylene and mixtures thereof.

Figure 2:
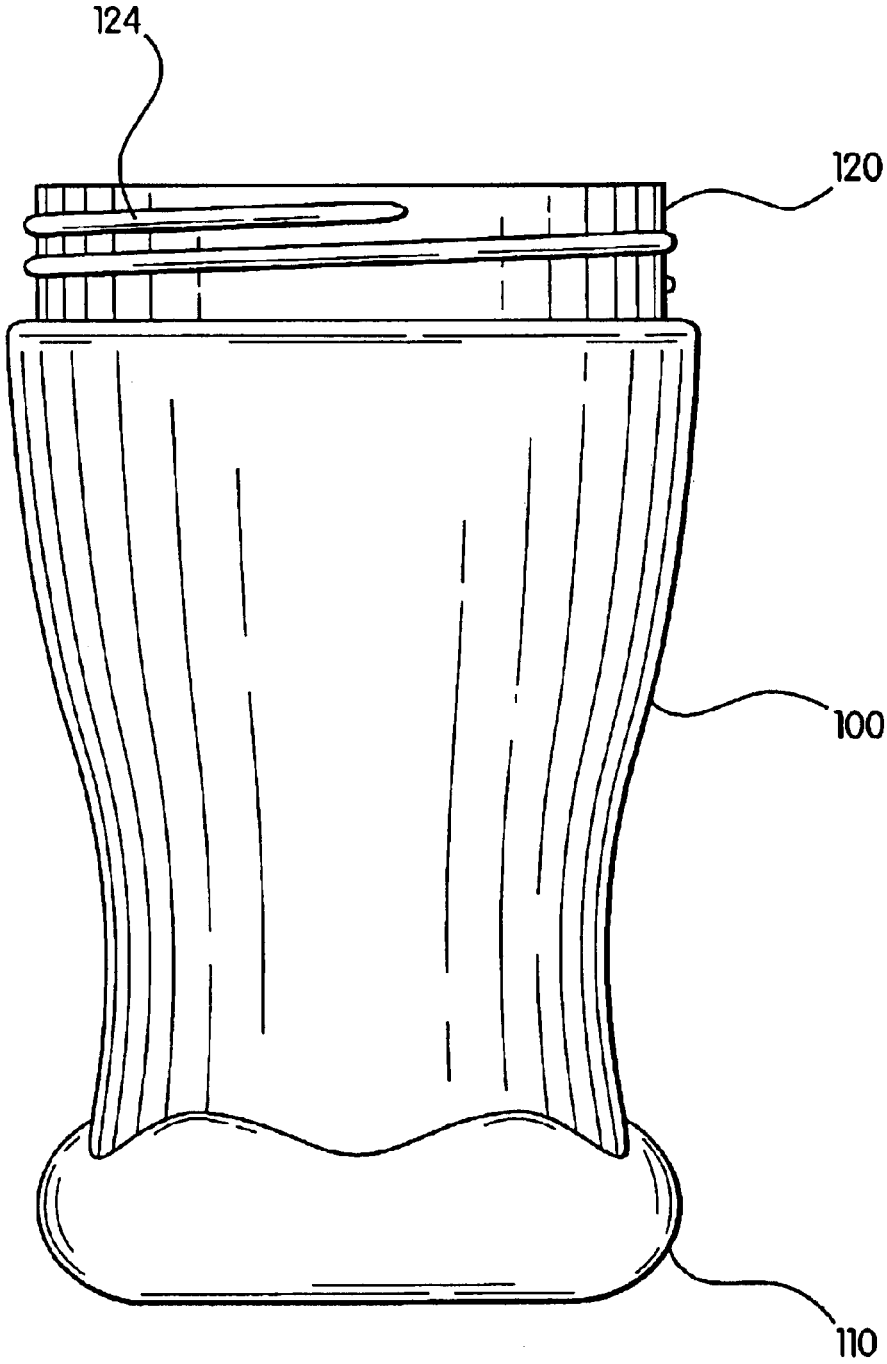
FIG. 2 is a front elevational view of the reservoir of the cup in accordance with an embodiment of the present invention.

FIG. 2 depicts a front elevational view of the reservoir 100. The reservoir 100 may be of any shape that is suitable for holding a liquid. For example, the reservoir 100 may be substantially cylindrical or take the form of a chalice or goblet, as shown in FIG. 2. One skilled in the art may pick a shape for the reservoir 100 that is suitable for grasping and handling by children. Furthermore, the reservoir 100 should be able to contain a volume of liquid that is suitable for drinking by children. For example, any volume from about five ounces (approx. 147 mL) to about twelve ounces (approx. 355 mL).

Referring to FIGS. 1 and 2, the reservoir 100 has base 110 and top end 120. The base 110 should be designed such that it can support the container 10 when the container 10 is vertical. The top end 120 serves as the exit point for the liquid from the reservoir 100. The outer surface of the top end 120 has fastening structure 124 thereon. The fastening structure 124 allows top 200 to attach or connect to the reservoir 100. For example, the fastening structure 124 can be an annular groove, an annular ring or a snap-fit. Preferably, the fastening structure 124 is a spiral or thread. This threading allows the top 200 to be threadably attached to the reservoir 100. Although not necessary, having the top 200 be detachable from the reservoir 100 allows a user to better access the interior of the reservoir 100 for cleaning and filling.

Figure 3:
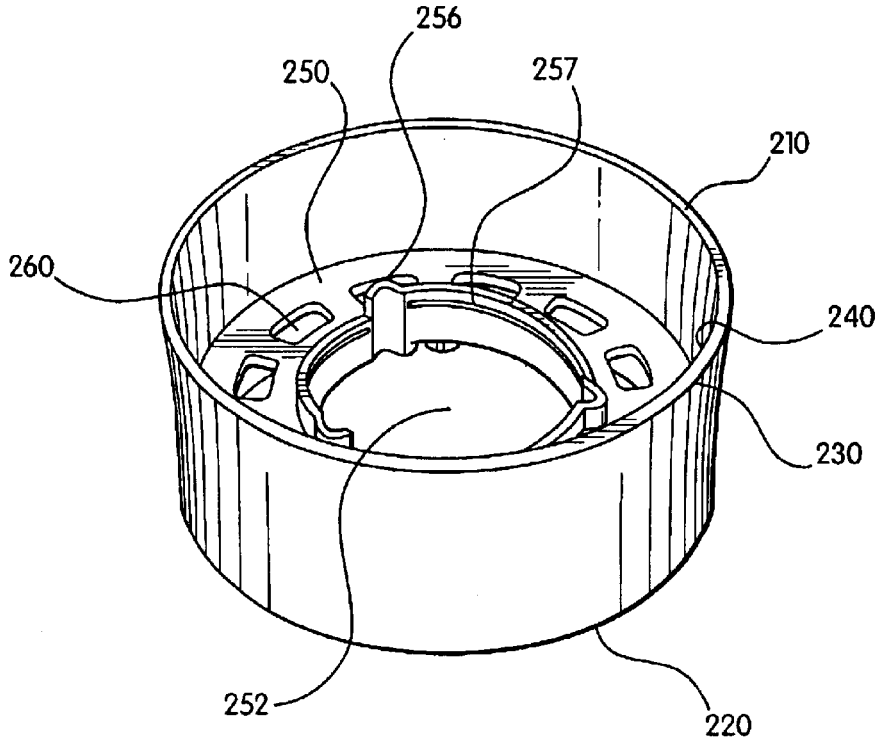
FIG. 3 is a perspective view of the top of the cup in accordance with an embodiment of the present invention.
Figure 4:
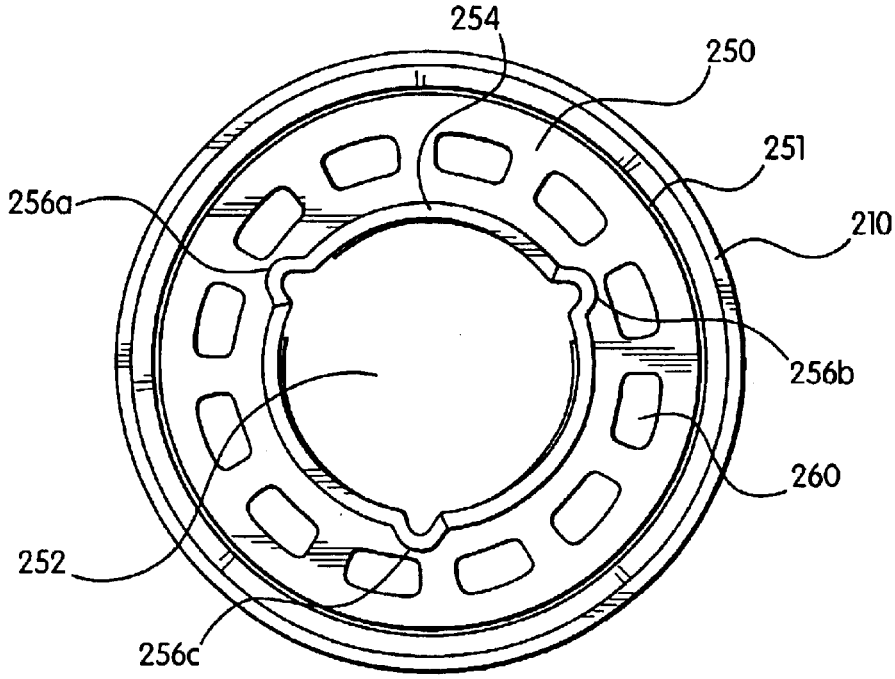
FIG. 4 is a top view of the top of the cup in accordance with an embodiment of the present invention.
Figure 5:
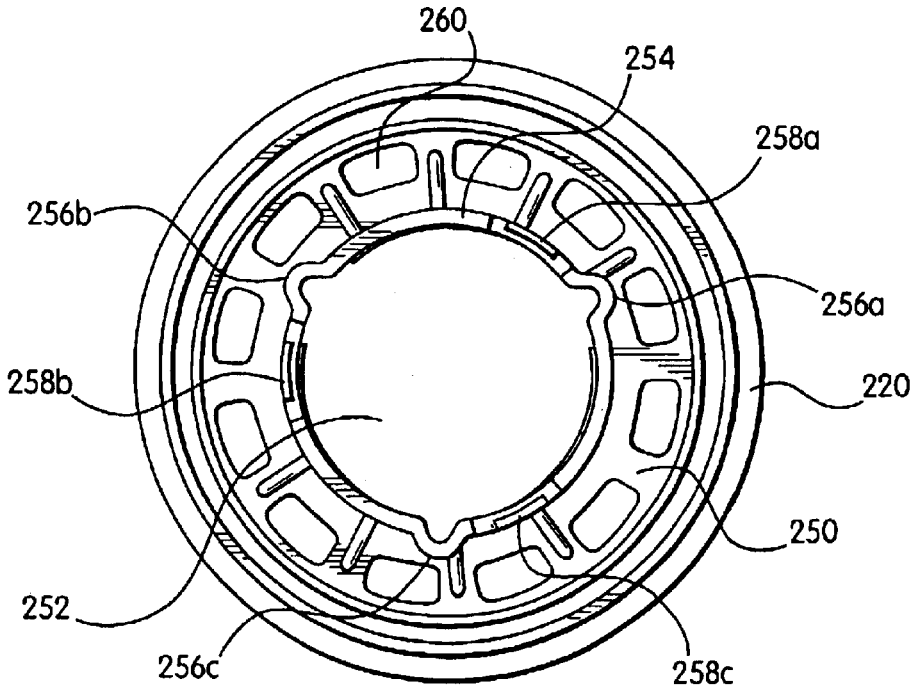
FIG. 5 is a bottom view of the top of the cup in accordance with an embodiment of the present invention.

FIGS. 3–5 show perspective, top and bottom views of the top 200, respectively. The top 200 has top rim 210, bottom rim 220, outer wall 230 and inner wall 240. Extending across the top 200 and from the inner wall 240 is plate 250. The plate 250 is situated between the top rim 210 and the bottom rim 220 and parallel to the planes that contain the top rim 210 and the bottom rim 220. The center of the plate 250 is a circular opening or central passage 252. Along the perimeter of the central passage 252 is passage wall 254. The passage wall 254, e.g., is concentric with the outer wall 230 and the inner wall 240. Around the top perimeter of the plate 250 is, e.g., a circular seal groove 251. When the lid 300 is locked in top 200, the groove 251 is in physical contact with the edge of lid 300; this is discussed in more detail below. Located adjacent to the multiple guide slots 256 and on the passage wall 254 are position locks 258. The position locks 258 can be located, e.g., clockwise or counterclockwise from the multiple guide slots 256 depending on the rotation of the lid 300 in the top 200. For example, if the lid 300 were to be rotated clockwise with respect to the top 200 as viewed from the top, then each position lock 258 is located to the left of a corresponding guide slot 256 when viewing the bottom of the top 200. The position locks 258 serve to hold lid 300 in an open, or "drink" position. The edge of each arcuate piece of the passage wall 254 between each guide slot 256 and the next locking slot 258, e.g., between the guide slot 256*a* and the position lock 258*b*, is sloped or tapered as the position tabs 326 travel along such arcuate piece of the passage wall 254. Also along the inner surface of the passage wall 254 are grooves, or drive ribs 257. The drive ribs 257 serve as attachment points for the lid 300, as will be seen later.

Disposed along the plate 250 between the passage wall 254 and the inner wall 240 are vents 260. The vents 260 extend through the entire thickness of the plate 250. The vents 260 can be of any shape, number and size. For example, as shown in FIGS. 3 and 4, vents 260 are trapezoidal in shape and are twelve in number. When the container 10 is tilted downward, liquid flows from the reservoir 100 and through the top 200 via the vents 260.

FIGS. 6–9 depict top perspective, front, side and bottom perspective views of the lid 300, respectively. The lid 300 provides a mechanism to seal the reservoir 100 and the top 200 to prevent any liquid from exiting the container 10 when the lid 300 is sealed. The lid 300 has upper portion 310 and lower portion 320 which are, for exampled, one-piece integrally formed together. The upper portion 310 is, e.g., a disc that has a diameter that approximates that of the inner wall 240 of the top 200. Along the perimeter of bottom surface of upper portion 210 is edge 316. For example, the edge 316 projects axially away from the bottom surface of upper portion. The edge 316 should have a thickness that is compatible with the width of groove 251 in the plate 250. When the lid 300 is inserted in the top 200 and closed, the upper portion 310 of the lid is disposed or oriented below the top rim 210 of top 200 to form a physical seal. Additionally, e.g., when the lid 300 is closed, the upper portion 310 covers the vents 260 and prevents any liquid from flowing out of the reservoir 200 and through the vents 260. When the lid 300 is opened or in an open position, the lid 300 remains disposed or oriented below the top rim 210 of top 200. Although it is preferable that the edges of the upper portion 310 touch the inner wall 240, e.g., to form a physical seal, when the lid 300 is locked or closed, it is not necessary provided that the vents 260 are sufficiently covered by the upper portion 310 when the lid 300 is locked or closed. On the top surface 312 of upper portion 310 is handle 314. Handle 314 provides a means for a user to easily remove lid 300 from top 200. Additionally, handle 314 provides a place for a user to grasp when rotating lid 300.

Figure 6:
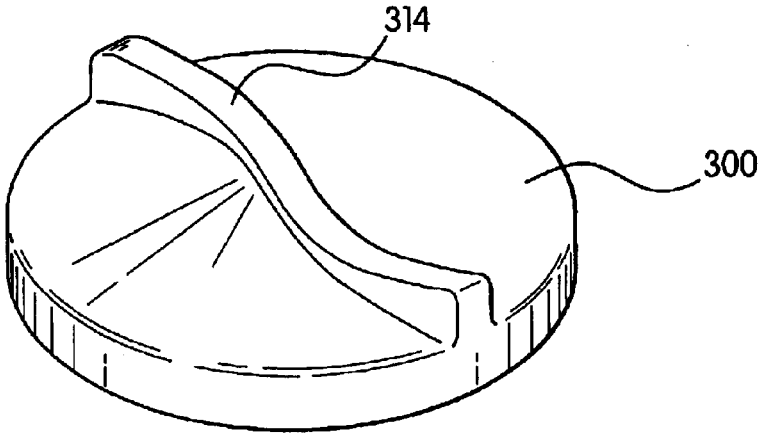
FIG. 6 is a top perspective view of the lid of the cup in accordance with an embodiment of the present invention.
Figure 7:
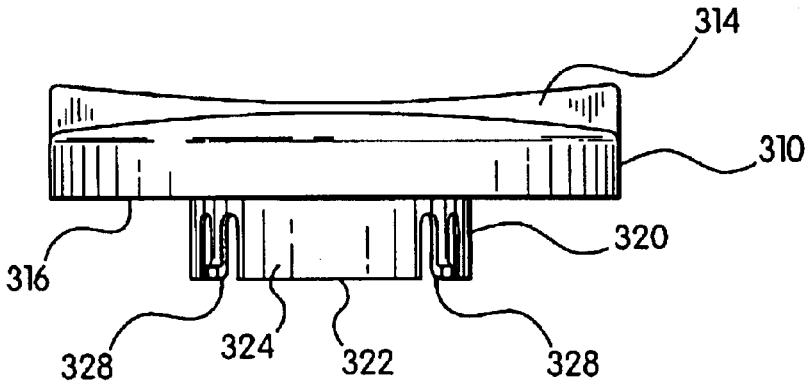
FIG. 7 is a front elevational view of the lid of the cup in accordance with an embodiment of the present invention.
Figure 8:
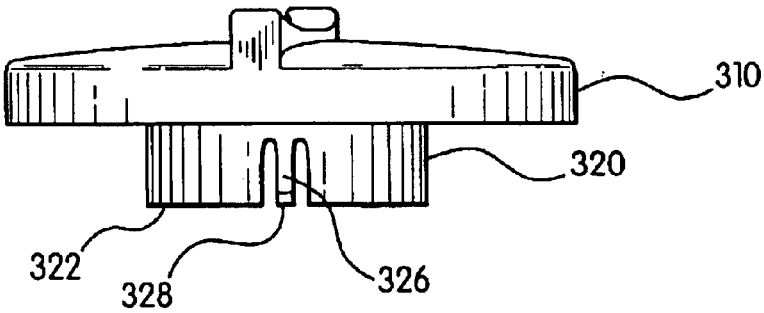
FIG. 8 is a side elevational view of the lid of the cup in accordance with an embodiment of the present invention.
Figure 9:
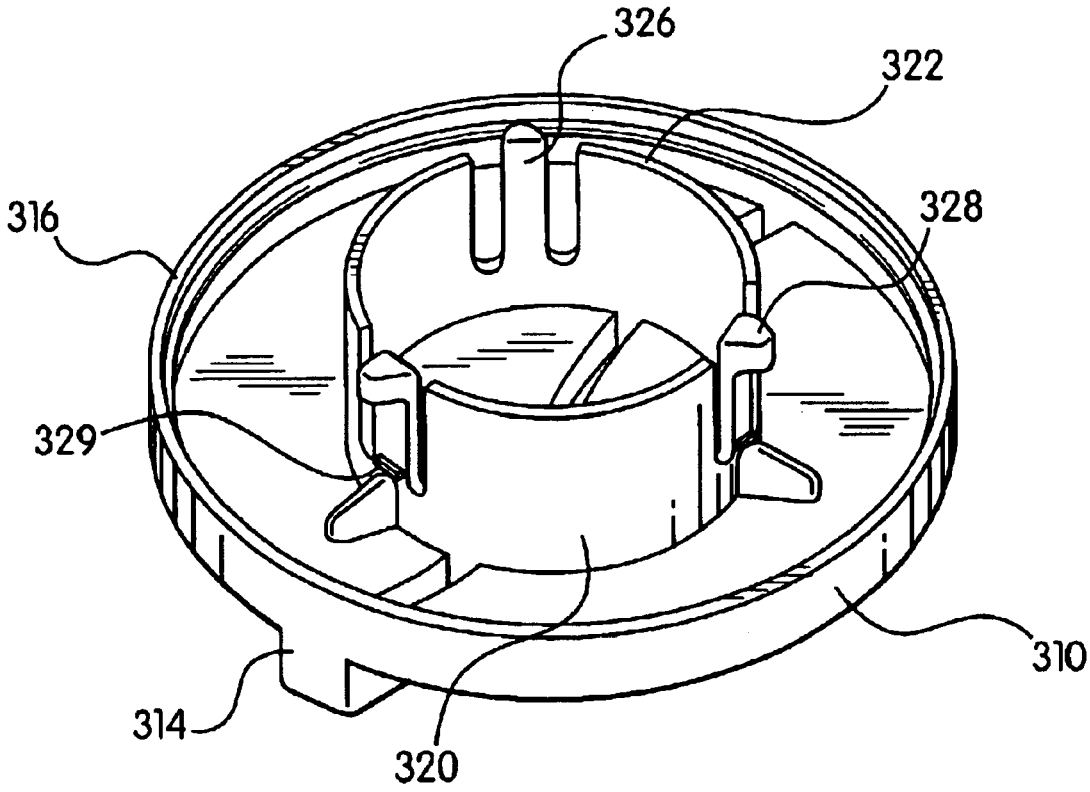
FIG. 9 is a bottom perspective view of the lid of the cup in accordance with an embodiment of the present invention.

Projecting from the bottom surface of the lid 300 is the lower portion 320. Although as depicted in FIGS. 5–7, the lower portion 320 is cylindrical and has edge 322, the lower portion 320 can be any other shape provided that such shape is compatible with the central passage 252. What is meant by "compatible" is that the central passage 252 and the lower portion 320 have shapes that are similar. For example, if the central passage 252 is circular than the lower portion 320 is cylindrical and the edge 322 is circular. The diameters of the central passage 252 should closely match that of the lower portion 320.

Along the distal end of the lower portion 320 opposite of the upper portion 310 are position tabs 326. For example, the bottom portion 320 can have any number of position tabs 326, preferably three. Each position tab 326 is located along the perimeter of -edge 322 and formed into wall 324 of the lower portion 320. At the distal end of each position tab 326 is extension 328, which projects and extends perpendicular and away from the axis of the lower portion 320. Each extension 328 should match the shape of the guide slot 256 in the top 200. For example, if the extension 328 has a semi-circular shape, then the guide slot 256 should also have a semi-circular shape. Located along the wall 324 in between the position tab 326 and the upper portion 310 are thread tabs 329. For example, there is one thread tab 329 for each position tab 326. The thread tabs 329 are protrusions in the wall 324 that extend radially from the wall 324 of the lower portion 320. The thread tabs 329 prevent the lid 300 from falling out of the top 200 in the event that the container 10 is ever turned upside-down.

To assemble the container 10, the top 200 is attached, e.g., by screwing, onto the reservoir 100. The lid 300 is then inserted into the top 200 with the user ensuring that the position tabs 326 are aligned with the guide slots 256. As the lid 300 is inserted into the top 200, the position tabs 326 pass through the guide slots 256. Once the lid 300 is fully inserted into the top 200, the position tabs 326 engage the edge of the passage wall 254. This engagement of the position tabs 326 with the edge of the passage wall 254 of the top 200, e.g., helps to prevent the lid 300 from falling out of the top 200 when the container 10 is inverted or tipped over. As the user rotates the lid 300 in a clockwise fashion, the thread tabs 329 travel along the drive ribs 257 whereas the position tabs 326 travel along the arcuate section of the passage wall 254. Finally, the lid 300 has a complete physical seal when the edge 316 of upper portion 310 of lid 300 is fully engaged with the groove 251 of the plate 250 of the top 200.

To use the container 10, the user rotates in a counter-clockwise fashion the lid 300 a set number of degrees. The counter-rotation of the lid 300 creates a gap between the lid 300 and the inner wall 240 when the edge 316 of upper plate 310 of lid 300 is no longer fully engaged with groove 251 of the plate 250 of the top 200. When the child drinks from the container 10, fluid flows from the reservoir 100 through the vents 260 of the plate 250 and through the gap between the lid 300 and the inner wall 240 and ultimately into the user's mouth. No or minimal suction by the user is required or needed.

Additional features as known in the art can be added to the container 10 to enhance userability. For example, visual markers can be incorporated into the container 10 to show when the lid 300 is property aligned with top 200 to facilitate easy insertion of the lid 300 into the top 200. An example of a visual marker is an arrow on the lid 300 and a corresponding arrow on the top 200. Moreover, audible markers can be incorporated to signal to the user that the lid 300 has been locked: e.g., when the position tabs 326 are rotated into the is position locks 258, a "click" sound can be heard. Furthermore, to enhance the spill-proofness of the container 10, a gasket can be incorporated between the lid 300 and top 200.

It is understood that while the present invention has been described in conjunction with the detailed description thereof that the foregoing description is intended to illustrate and not limit the scope of the invention, which is defined by the scope of the following claims. Other aspects, advantages and modifications are within the scope of the claims.

What is claimed:

1. A cup comprising:

a) a reservoir;

b) a top, said top having a top rim, an inner wall and a passage wall, said passage wall having a plurality of guide slots, said passage wall defining a central passage;

c) a plate having a plurality of vents being disposed between said inner wall and said passage wall, said plate having a seal groove along its top perimeter;

d) a lid having an upper portion and a lower portion one-piece inteqrally formed with and extending from said upper portion; said lower portion being sized to fit in said central passage and having a plurality of position tabs located on a distal end of said lower portion, said lower portion of said lid is releasably attached to said top and rotatable with respect to said top, said upper portion having an edge;

wherein when said lid is attached to said top, said position tabs pass through said guide slots and engage said passage wall, and said edge engages said seal groove when said lid is in a closed position.

2. The cup of claim 1, wherein said central passage is circular.

3. The cup of claim 1, wherein said lower portion is cylindrical.

4. The cup of claim 1, wherein said passage wall further comprises a plurality of drive ribs.

5. The cup of claim 1, wherein said passage wall further comprises a plurality of position locks.

6. The cup of claim 1, wherein said plate is substantially parallel to said top rim.

7. The cup of claim 1, wherein said lid further comprises a handle.

* * * * *